US006809622B2

(12) United States Patent
Hirohashi et al.

(10) Patent No.: US 6,809,622 B2
(45) Date of Patent: Oct. 26, 2004

(54) COIL DEVICE

(75) Inventors: Toru Hirohashi, Minato-ku (JP); Kiyoshi Hironaka, Minato-ku (JP); Yasuo Yamashita, Minato-ku (JP); Masaki Shinoda, Minato-ku (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 10/124,368

(22) Filed: Apr. 18, 2002

(65) Prior Publication Data

US 2002/0175794 A1 Nov. 28, 2002

(30) Foreign Application Priority Data

Apr. 20, 2001 (JP) ..... 2001-122975

(51) Int. Cl.[7] ..... H01F 27/29
(52) U.S. Cl. ..... 336/192; 336/83; 336/200
(58) Field of Search ..... 336/65, 83, 90, 336/107, 192, 198, 200, 208, 232

(56) References Cited

U.S. PATENT DOCUMENTS 5,307,041 A * 4/1994 Kato et al. ..... 336/83
5,751,203 A * 5/1998 Tsutsumi et al. ..... 336/65
6,069,550 A * 5/2000 Huang ..... 336/192
6,292,083 B1 * 9/2001 Tajima et al. ..... 336/192

FOREIGN PATENT DOCUMENTS

JP 07-106137 * 4/1995
JP 07-320961 * 12/1995

* cited by examiner

*Primary Examiner*—Tuyen T Nguyen
(74) *Attorney, Agent, or Firm*—Wenderoth, Lind & Ponack, L.L.P.

(57) ABSTRACT

A coil device, which has a coil composed of a core and a winding on the core, and a terminal having a base seat for holding the coil and terminal elements. The coil device has a flange on one side of the core with no flange being provided on the other side of the core. This allows molding by using a mold and can reduce a thickness of the flange of the core and thereby realize a reduction in the thickness of the coil device.

4 Claims, 9 Drawing Sheets

(a)

(b)

(c)

(a)

(b)

(c)

(a)

(b)

(c)

(a)

(b)

COIL DEVICE

BACKGROUND OF THE INVENTION

This invention relates to a coil device which constitutes a winding component such as a choke coil and a transformer.

FIGS. 9(*a*), (*b*), (*c*) and (*d*) are illustrations showing an example of a conventional coil and its assembly. The conventional coil 1, as shown in (*a*) and (*b*) of FIG. 9, has a coil 4 which is formed by providing a winding 3 on a body portion 2*b* of a drum core 2 having flanges 2*a*, 2*a* on its opposed ends and, as shown in (*c*) and (*d*) of FIG. 9, a terminal 9, of synthetic resin is prepared by embedding two terminal elements 8, 8 in a base seat 5. The coil 4 is mounted on a circular, coil holding portion 6 on a central portion of the base seat 5, and fixed thereto by an adhesive agent or the like.

Further, as shown in FIGS. 10(*a*) and (*b*), the terminal elements 8, 8 of the terminal 9 is formed with a crank-shaped lead frame which has a wrapping portion 8*a* for connection with an end of the coil 4 and a mounting portion 8*b* which is exposed at a back surface of the terminal 9. In general, the lead frame described above is embedded in a terminal fixing portion 7 which is projected from an end portion of the base seat 5 by means of an insert molding technique.

Many attempts have been made for miniaturization and thickness reduction of the electronic devices for meeting with the requirements of miniaturization and thickness reduction in each of the electronic elements and components for the devices. In the circumstances as described above, there are several inconveniences and problems to be solved with respect to a further miniaturization and thickness reduction in the coil device.

Firstly, a total height of the coil device is determined by a thickness of the coil and a height of a mounting surface of the coil on a base seat, and therefore it would be effective to reduce the height of the core for the purposes of thickness reduction. However, in the case of a drum core 2 of the structure described above, a middle portion of a tubular core of magnetic material is cut out to form a bobbin shaped structure as shown in FIG. 9(*a*) and, therefore, it is quite difficult from the viewpoint of the cutting processing technique to extensively reduce the thickness "a" and the dimension of a winding portion "b" of a flange 2*a*. In formation of the core, the cutting process of the middle portion of the tubular body as described above requires an extremely high precision technique, with the result being reduced productivity.

Secondly, the terminal elements 8 in the conventional prior art coil device has a structure in which opposed ends of a lead frame are embedded into mold resin as shown in FIG. 10, and this causes a reduction of the area of a resin fixture portion (that is, an embedding portion of the terminal elements 8 at a terminal fixture portion 7) with the advance of miniaturization of the terminal 9, and thus the fixing strength for the terminal elements 8 is lowered and consequently the terminal elements likely fall out, resulting in a loss of reliability.

SUMMARY OF THE INVENTION

It is, therefore, an object of the present invention to provide, in view of the above situation, a coil device in which the height of a winding component can be reduced without sacrificing practical usability thereof.

Another object of the present invention is to provide a new coil device, which permits adaptability to the recent trend of miniaturization and thickness reduction of electronic appliances.

A further object of the present invention is to provide a new coil device, which provides improvement in electromagnetic properties and reliability.

According to one aspect of the present invention, there is essentially provided a coil device comprising a coil composed of a core and a winding on the core, and a terminal having a base seat for holding the coil and terminal elements. The coil device has a flange on one side of the core, and no flange is provided on the other side of the core.

In the one-sided flange structure described above, formation can be made by using a mold without using a cutting processing technique, so that the flange can be made thinner in contrast to a flange formed with the cutting technique applied in the conventional prior art. Thus, a reduction in the height of the core can be realized.

In a preferred embodiment, the terminal has a coil retaining space (hole or recess) for securing therein a body portion of the core. This will permit easy positioning of the coil and improved assembly efficiency. Further, since a marginal space for assembly is permitted in a height direction, dispersion of height in a core production can be absorbed in the assembly procedure, so that the dimensional allowance can be increased.

In a further embodiment, the base seat has a projected rim at its circumferential end so that the projected rim overlaps the coil. Further, the base seat is made of a mixture of a synthetic resin material and a magnetic material. This permits the formation of a closed magnetic circuit by combining the projected rim of the base seat and the flange of the core, so that magnetic leakage of the coil is reduced to thereby improve the electromagnetic properties.

In an additional preferred embodiment, an opposed end of a one-sided flange core is substituted with a jig, and fusion-bonded wire is wound directly around the body portion of the core. When a winding is applied to the one-sided flange core, a toroidal coil can be inserted or fitted to the body portion of the core. In this embodiment, the fusion-bonded wire is applied directly to the body portion of the core. At the time of winding, the jig (a butt joint jig) for a winding machine is used for the other flange (that is, an "excluded" flange of the one-sided flange of the core) for a winding frame so that winding is made between the excluded flange and the one-sided, existing flange. In the case of the direct winding as described, no clearance is required relative to the body portion of the core as is required in the toroidal coil and, therefore, the space for the clearance can effectively be used such that the winding number can be increased and a dimension of the wire can be increased so that improvement in electromagnetic properties can be obtained. Further, assembly efficiency can be improved relative to the case in which a toroidal coil is used.

In a second aspect of the present invention, there is essentially provided a coil device comprising a coil composed of a core and a winding on the core, and a terminal having a base seat for holding the coil and a terminal element. The base seat has a terminal fitting portion and a terminal element embedded in the terminal fitting portion, and the terminal element has wrapping (or bundling) portions at its ends and a mounting portion at its middle portion. Also, only a widthwise portion of the mounting portion is exposed.

In this structure, the portion to be fixed by the molded resin is extended to thereby increase the fixing strength of the terminal elements. Further, this structure permits visual inspection of the welding condition of the terminal elements from an upper position.

In the second aspect of the invention described above, the mounting portion is exposed at the portion, which is positioned at the same place of the bottom surface of the terminal. This will facilitate further miniaturization and improvement in strength of the terminal elements because of the increase of a molded portion.

DETAILED DESCRIPTION OF THE EMBODIMENTS

Figure 1:
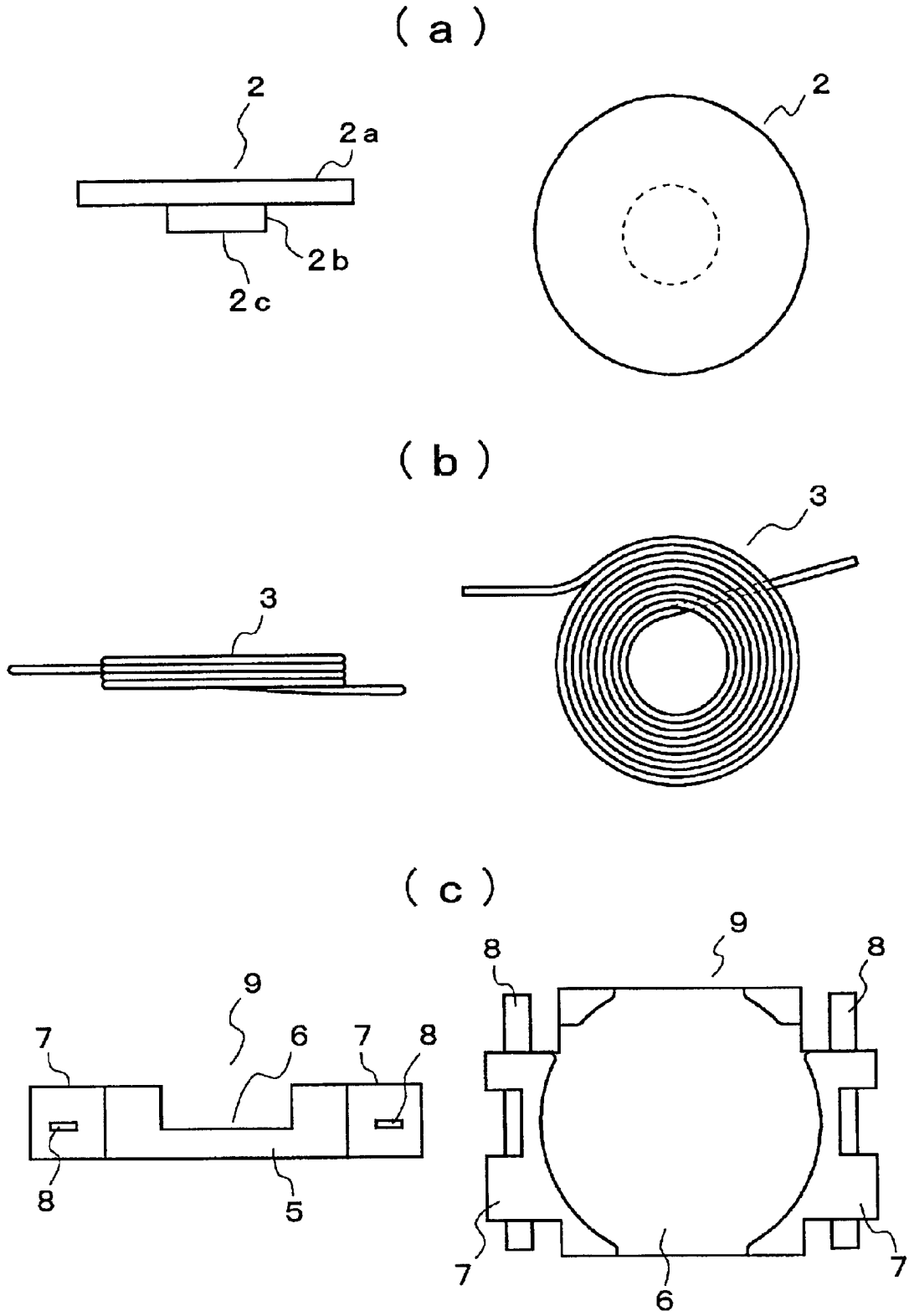
FIGS. 1(*a*), (*b*) and (*c*) are fragmented views showing a first embodiment of the invention wherein FIG. 1(*a*) shows a core, FIG. 1(*b*) shows a winding and FIG. 1(*c*) shows a terminal.

Several embodiments of the present invention will now be described with reference to the accompanying drawings, in which the same reference numerals represent the same or similar parts and elements throughout the various figures of the drawings.

Figure 2:
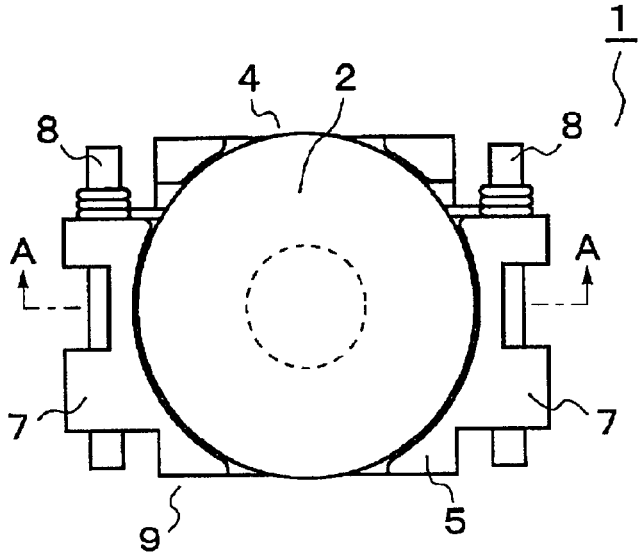
FIGS. 2(*a*), (*b*) and (*c*) show a coil device according to the first embodiment of the present invention, wherein FIG. 2(*a*) is a plan view, FIG. 2(*b*) is a front view and FIG. 2(*c*) is a sectional view taken along line A-A in FIG. 2(*a*).
Figure 2:
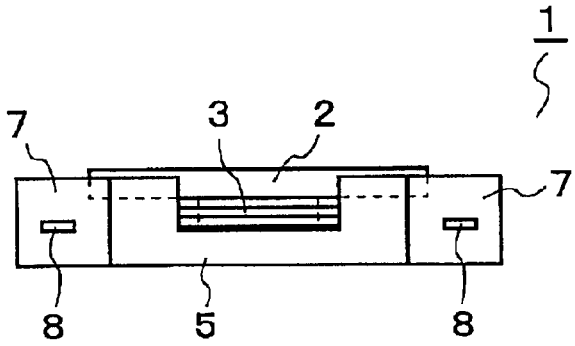
Figure 2:
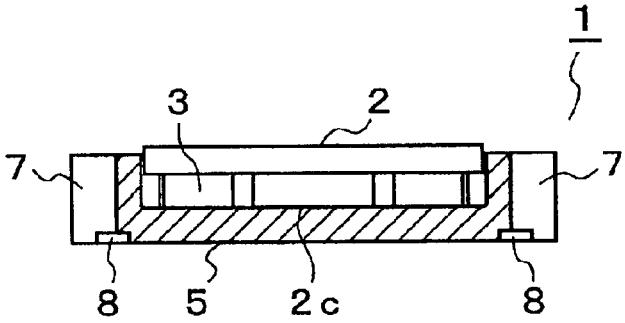
Figure 9:
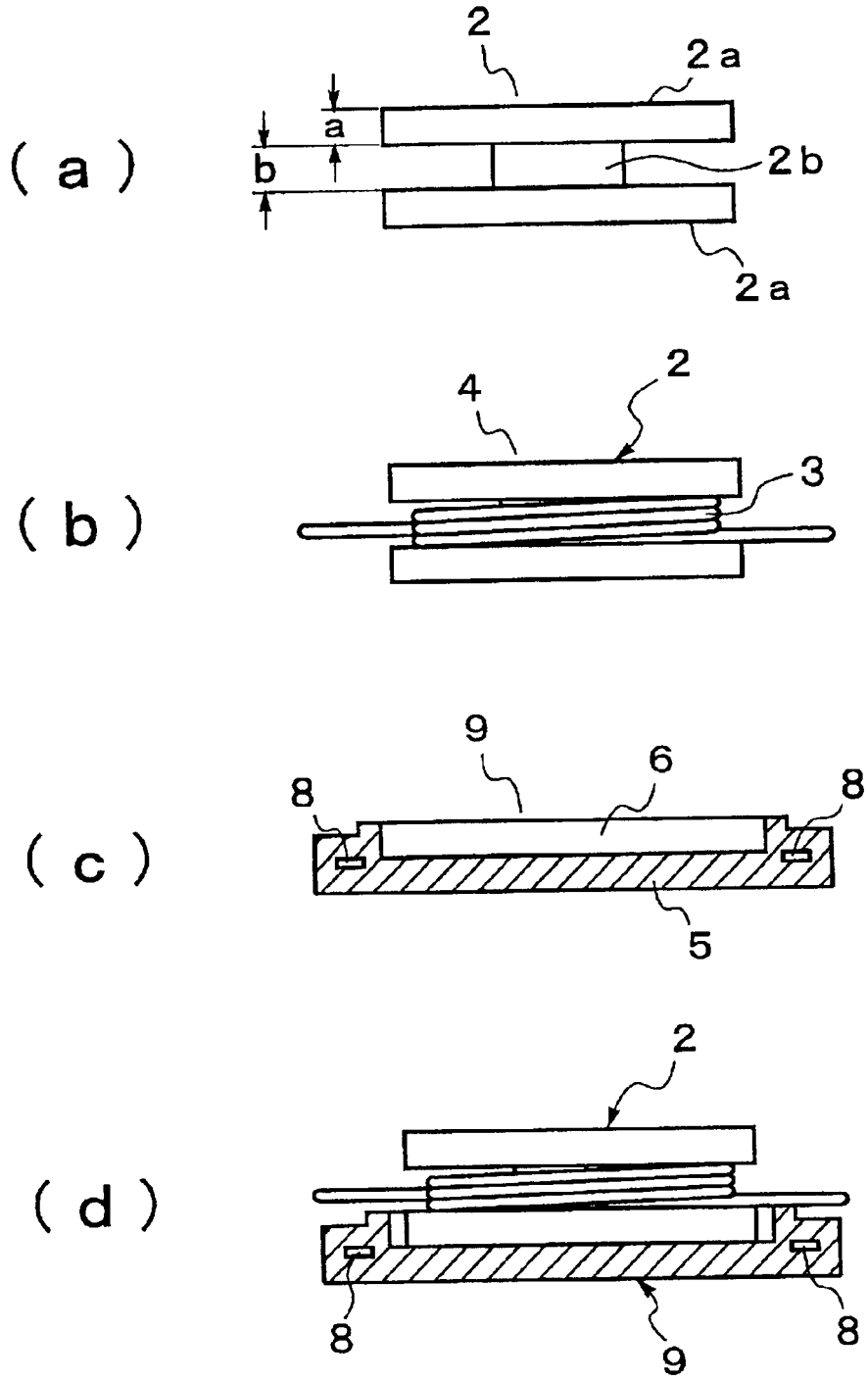
FIG. 9 (PRIOR ART)
FIGS. 9 and 10 show a conventional prior art coil device wherein FIGS. 9(*a*)–(*d*) show assembly of the coil device, and FIGS. 10(*a*) and (*b*) show the structure of the prior art coil device.

Referring first to FIGS. 1 and 2 showing a first embodiment of the invention, a coil device of the present invention, similar to the conventional coil device of FIG. 9, has a structure composed by a combination of a coil 4 having a core 2 and a winding 3 and a terminal 9. However, a shape of the core 2 of the present invention is different from that of the core of the prior art.

Namely, the conventional prior art core has a bobbin structure having flanges at opposite ends of the body portion, but the core 2 of the present invention has a single flange 2*a* on one of the sides of the body portion 2*b*.

In the first embodiment of the invention, a toroidal coil 3, which is formed of a winding of heat-fused (or, fusion bonded) wire, is adapted to the core 2 in such a manner that the toroidal coil 3 is inserted on the body portion of the core 2 to form a coil and then the end surface 2*c* of the body portion 2*b* is abutted against a coil holding portion 6. Thus, a coil device 1 of the first embodiment of the invention is completed as shown in FIG. 2.

The core 2 is a one-sided flange structure as described above and the shape can be simplified so that it can be formed by using a mold. This will provide a remarkable improvement in productivity relative to the conventional drum shaped cores, which have been made by a high precision conventional core, and consequently the height of the core 2 can be reduced so that the overall thickness of the coil device can be reduced.

Figure 3:
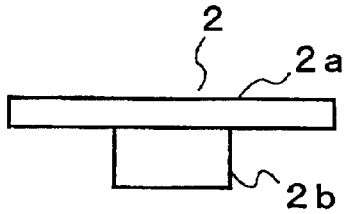
FIGS. 3(*a*), (*b*) and (*c*) show a second embodiment of the invention wherein FIG. 3(*a*) shows a core, FIG. 3(*b*) shows a winding and FIG. 3(*c*) shows a terminal.
Figure 3:
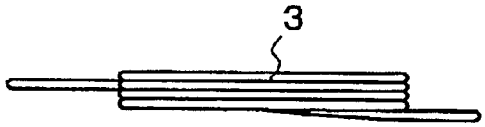
Figure 3:
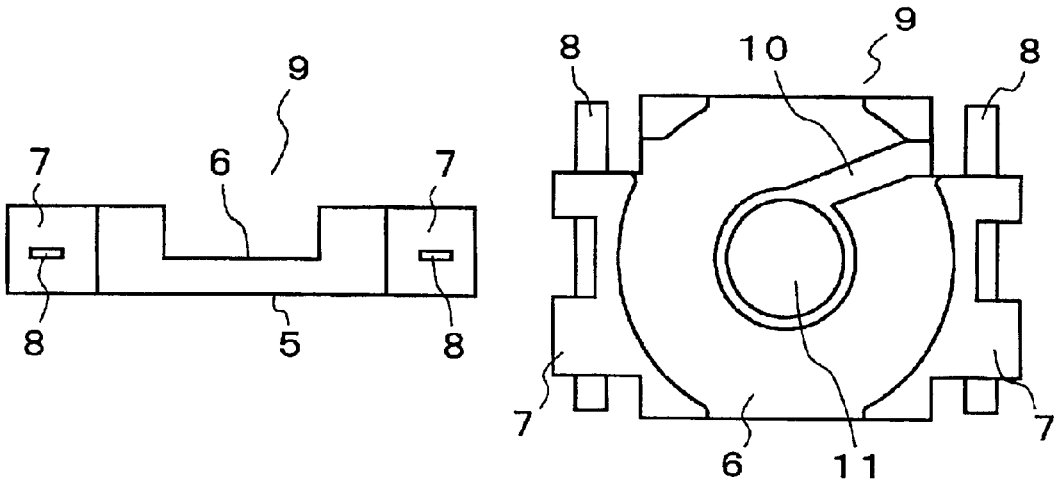

A second embodiment of the invention will now be described with reference to FIGS. 3 and 4. While in the first embodiment the end surface 2*c* of the body portion 2*b* of the core 2 is abutted against the bottom surface of the coil holding portion 6, a circular hole or recess 11 is formed at a central bottom surface of the coil holding portion 6 in the second embodiment so that the body portion 2*b* of the core 2 can be fitted in the circular hole or recess 11. Thus, the dimension of body portion 2*b* is determined such that it is formed longer than the core 2 of the first embodiment by the length of the portion that is fitted into the circular hole or recess 11. Incidentally, a toroidal coil is used in this case as the winding 3.

Figure 4:
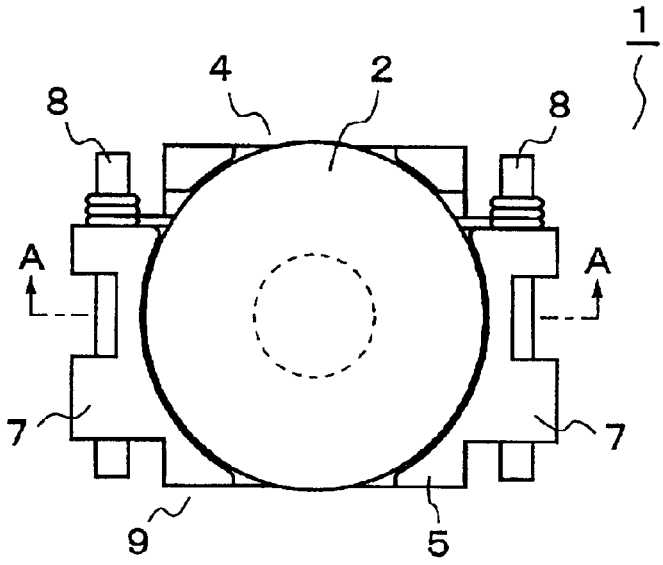
FIGS. 4(*a*), (*b*) and (*c*) show a coil device according to the second embodiment of the present invention, wherein FIG. 4(*a*) is a plan view, FIG. 4(*b*) is a front view and FIG. 4(*c*) is a sectional view taken along line A-A in FIG. 4(*a*).
Figure 4:
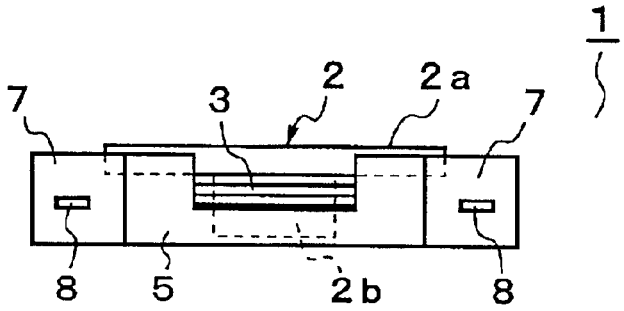
Figure 4:
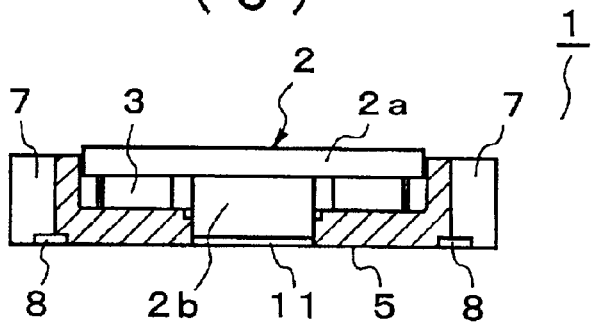
Figure 5:
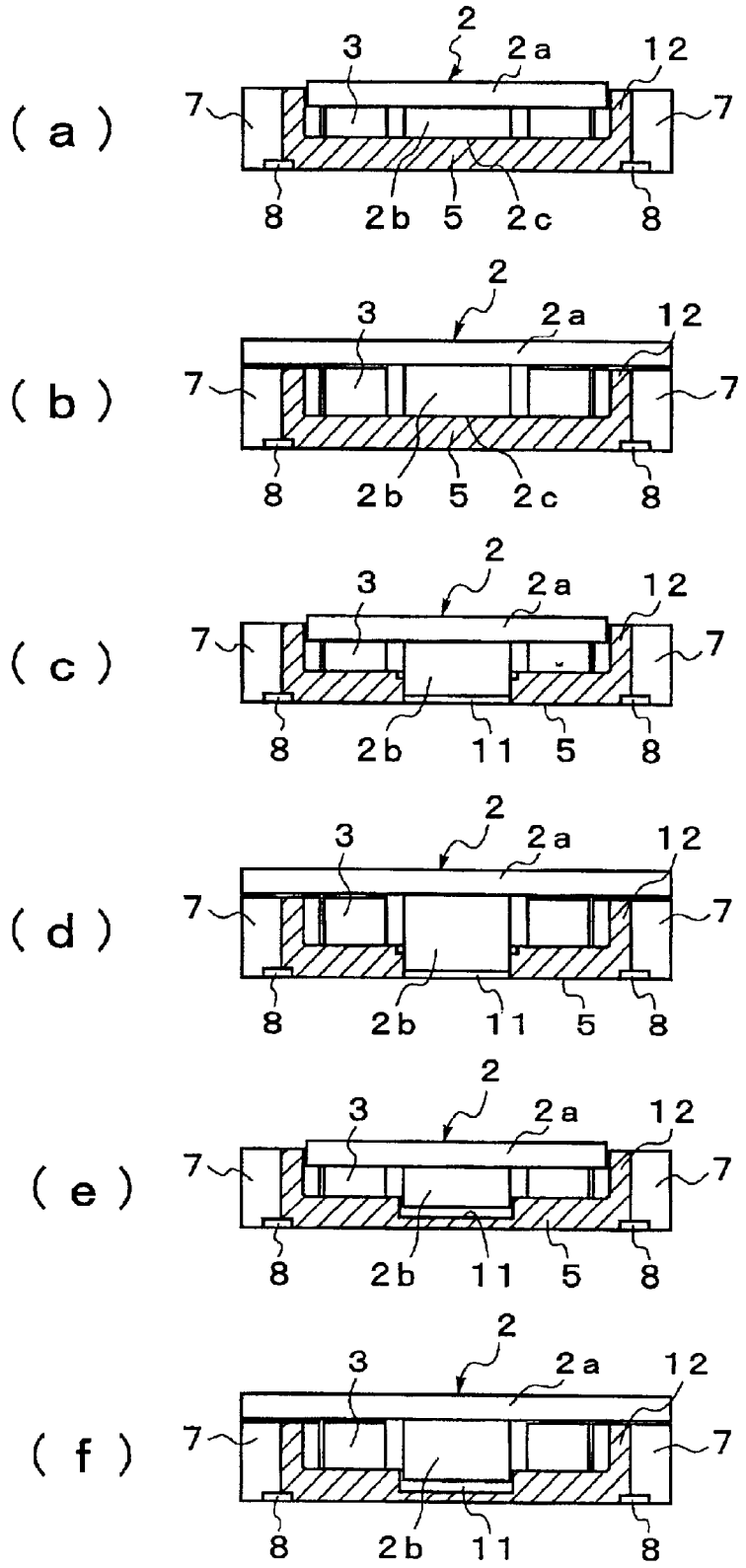
FIGS. 5(*a*) through (*f*) shows a coil device according to a third embodiment of the invention.

In the structure described above, the body portion 2*b* of the core 2 is inserted into the toroidal coil or winding 3 to form a coil 4 and then the end portion of the body portion 2*b* is fitted to the circular hole or recess 11 of the base seat 5 to form the coil device 1 of the second embodiment of the invention as shown in FIG. 4. The circular hole or recess 11 may be a through-hole as shown in the structure of FIG. 3(*c*) or a recess with a bottom as shown in FIGS. 5(*e*) and (*f*).

With the above-described structure, the core 2 is fitted in position, and positioning of the coil 4 is facilitated and more easily accomplished relative to the first embodiment of the invention. In such a fit-in structure, greater tolerance or allowance for assembly in the height direction is obtained so that scattering of the height in production can be absorbed or cancelled effectively by the process of assembly (that is, adjustment of fitting of the body portion 2*b*). In other words, in the conventional prior art structure, since a total height of a product is defined by each of the dimensions of the core 2, the winding 3 and the terminal 9 (base seat 5), the tolerance or allowance of each dimension must be taken into consideration at the time of assembly of the parts and elements. By contrast, in this embodiment of the present invention, an allowance for the core 2, which is especially severe and strict among other allowances, can substantially be disregarded and neglected.

In the second embodiment of the invention described above, as shown in FIG. 3(*c*), a groove 10 is formed on the bottom surface of the coil holding portion 6 so that an end of the wire 3 is directed to the terminal elements 8 through the groove 10. This will avoid any defective influence due to an expansion of the thickness of the wire by positioning a starting portion of the winding wire in the groove to prevent an expansion of the height.

A third embodiment of the invention will be described with reference to FIGS. 5(*a*) through (*f*). When the core of the one-sided flange (that is, the core having only a single flange) is used, it provides an open magnetic circuit, which results in increased leakage of a magnetic flux. In the third embodiment of the invention, a projected rim 12 is formed on a circumferential portion of the base seat 5 to wrap or cover the coil at the assembly step. Examples of this structure is shown in FIGS. 5(*a*) through (*f*).

FIG. 5(*a*) shows a structure in which a flange 2*a* of the core 2 is snuggly fitted in a space defined by the projected rim 12 and FIG. 5(*b*) shows a structure in which the flange 2*a* of the core 2 is extended to cover or overlay the projected rim 12. In either case of FIGS. 5(*a*) and (*b*), the core 2 is fixed to the base seat 5 by abutting the end surface 2*c* of the body portion 2*b* of the core 2 against the base seat 5 in a similar manner as in the first embodiment of the invention.

In the structures shown in FIGS. 5(*c*) to (*f*), the fixture between the core 2 and the base seat 5 is made by fitting the body portion 2*b* in the base seat 5 in a similar manner as in the second embodiment described above.

In all the examples described above, the abutment between the flange 2*a* of the magnetic core 2 and the projected rim 12 of the magnetic base seat 5 provides a closed magnetic circuit from the flange 2*a* of the core 2 to the base seat 5 through the projected rim 12.

By the structure described above, in the coil device 1 which is the combination of the terminal 9 and the coil 4, magnetic flux leakage of the coil 4 is eliminated so that the number of windings of the coil 4 for a predetermined inductance can be reduced to thereby achieving downsizing or miniaturization of the coil device 1. Further, reduction of the winding number contributes to reduction of DC (direct current) resistance by increasing a thickness of the wire for the winding to consequently improve coil characteristics.

Comparison was made between the base seat 5 of the invention and a prior art base seat of a synthetic resin which employs no magnetic material, as set forth in Table 1 below.

TABLE 1

| | Inductance | Number of Winding | Diameter of Wire | Value of Resistance |
|---|---|---|---|---|
| Base seat of the invention | 4.7 $\mu$H | 22T | Φ 0.07 | 0.56 Ω |
| Base Seat of Prior Art | 4.7 $\mu$H | 30T | Φ 0.06 | 1.13 Ω |

A fourth embodiment of the invention will now be described. While the toroidal coil 3 is used in the first and second embodiments described above, a coil 4 of the fourth embodiment herein is formed by directly is winding a fusion bonded wire, which can be bonded by heat, around the body portion 2*b* of the one-sided flange core 2.

Figure 6:
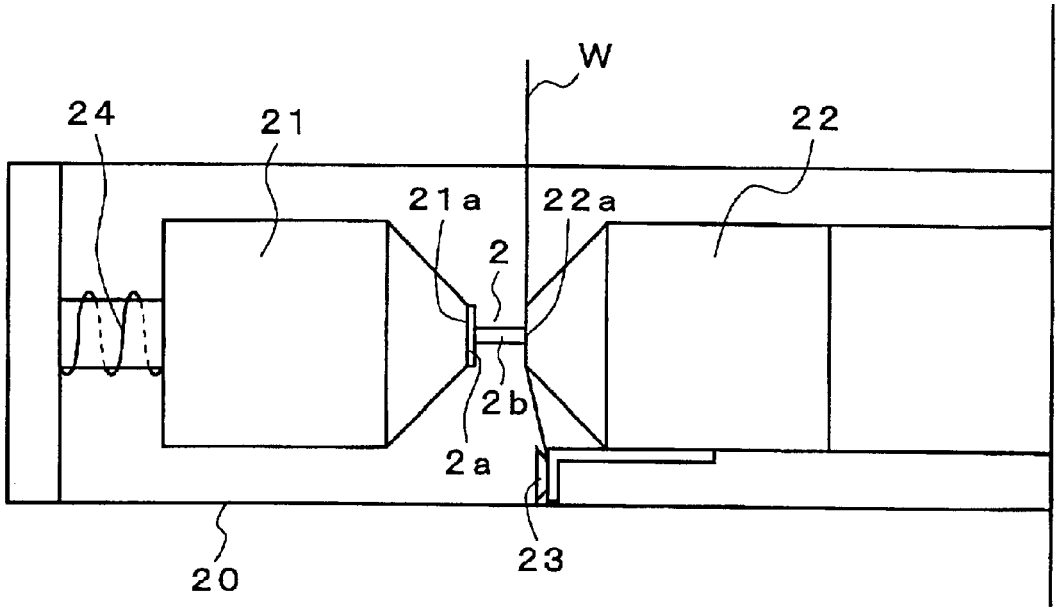
FIG. 6 is a schematic view showing a method of forming a coil according to the present invention.
Figure 7:
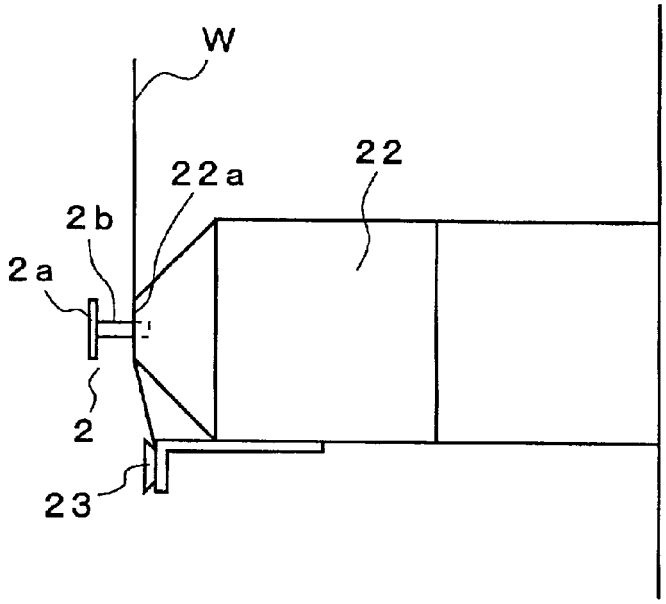
FIG. 7 is a schematic view showing another method of forming a coil according to the present invention.

FIGS. 6 and 7 show a method of winding the fusion bonded wire on the one-sided flange core 2 by utilizing a winding machine 20. The winding machine 20 has jigs 21, 22 which are spaced from each other and are rotated synchronously in the same direction, and the core 2 is resiliently held by the spring force of a spring 24 between the rotating jigs 21 and 22. The fusion bonded wire W, which is supplied through a reel 23, is wound on the body portion 2*b* of the core 2 to provide a predetermined winding. Incidentally, the winding machine 20 can be used for forming the aforementioned toroidal coil 3.

In the embodiment shown in FIG. 6, the one-sided flange core 2 is held between abutment portion 21*a*, 22*a* of the jigs 21, 22, respectively and the abutment portion 22*a* of the jig 22 is used as the other flange (that is, a deleted flange) of the one-sided flange core, so that winding frames or limits may be formed by the flange 2*a* of the core 2 and the abutment portion 22*a* of the jig 22 to provide a winding of the wire W on the portion confined by the winding frames thus formed.

In the embodiment shown in FIG. 7, the body portion 2*b* of the core 2 is partly chucked or held to the abutment portion 22*a* of the jig 22 and winding proceeds in a similar manner as in the embodiment of FIG. 6. In the embodiment of FIG. 7, only the jig 22 is used.

In either of the cases of FIGS. 6 and 7, the fusion bonded wire is used so that the wire is fusion-bonded after winding and, therefore, the wire is not unexpectedly unwound or loosened after the core 2 is removed from the jig but remains fixed to the one-sided flange core 2. This is similar to the case where the aforementioned toroidal coil is used.

When the toroidal coil is used, it is generally required in view of assembly efficiency that a diameter of an aperture of the toroidal coil 2 is larger than a diameter of the body portion 2*b* of the core 2 and this results in an increase in the diameter of the coil. However, in the fourth embodiment of the invention in which a direct winding is provided on the core, no clearance in diameters is required and, therefore, a winding volume of the winding frame can effectively be utilized to increase the winding number and thickness of the wire which leads to reduction of DC resistance. Thus, improvement in the coil characteristics can be realized. If the number of windings and the number of wires are fixed or predetermined, a diameter of the coil can be reduced to realize further miniaturization of the coil 4.

Further, in the case of using the toroidal core, handling and assembly of the coil (such as insertion or adoption of the body portion 2*b* of the core 2 to the aperture of the toroidal coil) will generally become more difficult as the product is further miniaturized. On the other hand, in the embodiment of FIGS. 6 and 7, it is necessary to take the difficulties in handling and assembly into consideration and, therefore, working efficiency can be improved.

Figure 8:
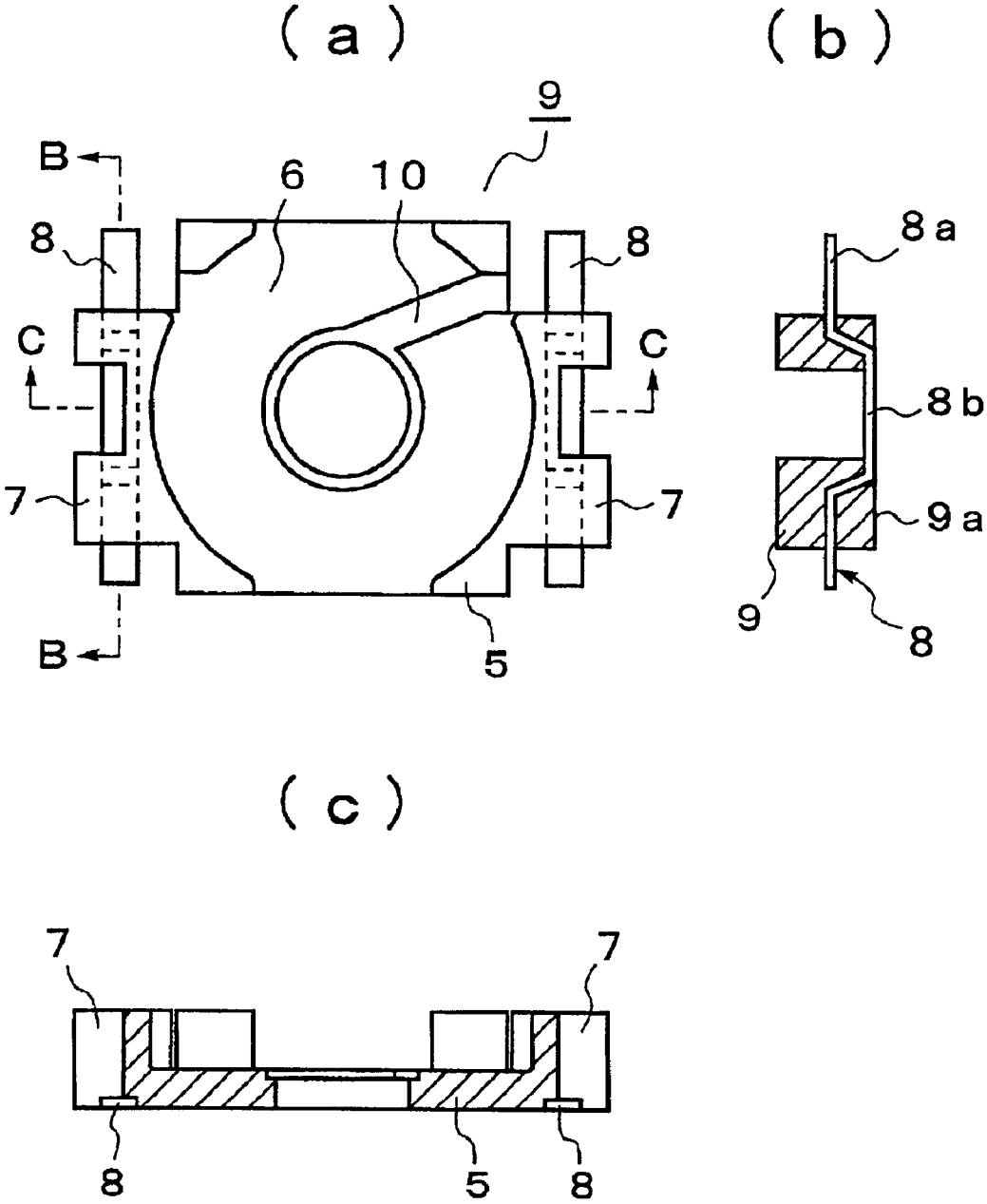
FIGS. 8(*a*), (*b*) and (*c*) show a terminal according to a fifth embodiment of the invention wherein FIG. 8(*a*) is a plan view, FIG. 8(*b*) is a sectional view taken along line B-B, and FIG. 8(*c*) is a sectional view taken along line C-C in FIG. 8(*a*).

FIGS. 8(*a*), (*b*) and (*c*) show a terminal structure 9 in a fifth embodiment of the invention. The terminal structure 9 has a disc-shaped base seat 5 and a coil holding portion 6 for mounting thereon a coil 4. The base seat 5 has, at its end portions, a pair of U-shaped terminal fitting portions 7, 7 located in an opposed relation as shown in FIG. 8(*a*), and each of the terminal fitting portions 7, 7 has a terminal element 8. As illustrated is in FIG. 8(*b*), the terminal element 8 is composed of a crank-shaped lead frame and has, at its end, a wrapping or bundling portion 8*a* which is connected with the winding end portion of the coil and also has, at its middle portion, a mounting portion 8*b* for mounting a surface mounting. The lead frame is embedded and fixed in the terminal-fitting portion 7 by an insert molding technique. At this moment, the mounting portion 8*b* is positioned in the space formed by the U-shaped terminal fitting portion 7, and the U-shaped portion is positioned on the same plane as the bottom portion of the base seat 5.

Figure 10:
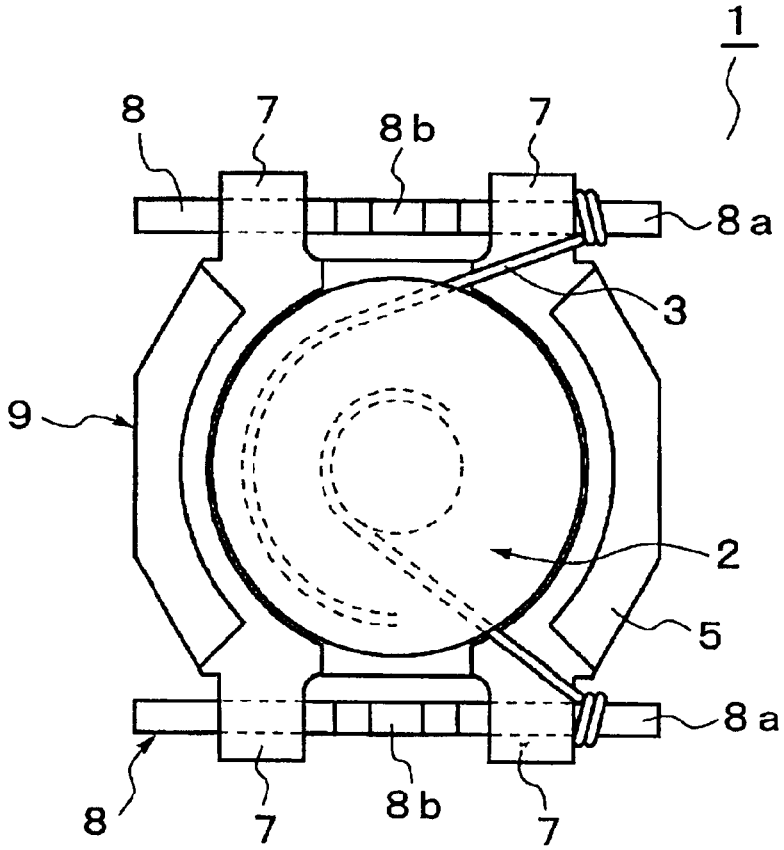
FIG. 10 (PRIOR ART)
Figure 10:
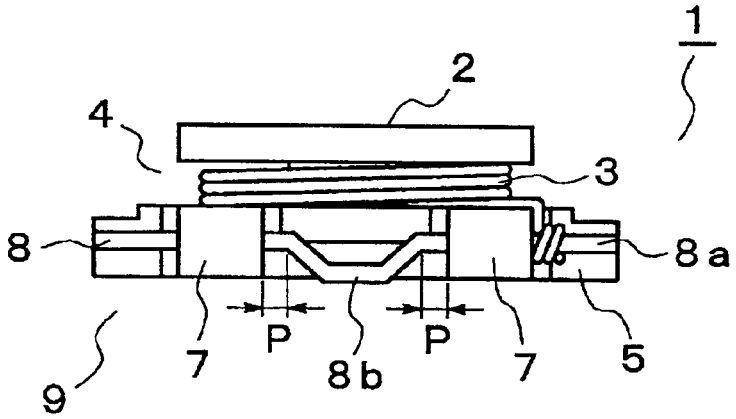
FIG. 10 (PRIOR ART)

The terminal 9 of the fifth embodiment shown in FIG. 8 is different from the prior art structure of FIG. 10 in that only a part of the mounting portion 8*b* in the widthwise direction is exposed from the molded resin, whereas in the conventional structure of FIG. 10 the mounting portion 8*b* is entirely exposed. By making only a part of the mounting portion 8*b* of the terminal element 8 exposed in this embodiment, a portion (illustrated at P in FIG. 10(*b*) of the drawing) for holding the terminal element 8 which has been required in a molding procedure in the conventional prior art is no longer required and, therefore, further miniaturization can be realized by reducing the holding portion (P). Further, also an obliquely bent portion of the terminal element 8 is embedded in the molded resin so that only a portion of the mounting portion 8*b*, which is positioned in the same plane as the bottom surface 9*a* of the terminal 9, is exposed.

By increasing the molded portions as described above, the fixing strength of the terminal element 8 can be increased.

Further, since the upper portion of the mounting portion 8*b* is removed, a visual inspection can be made with respect to a welding condition of the mounting portion 8*b*.

According to the present invention, an application of a one-sided flange core enables molding or formation by using a mold, and the flange can be made thinner than with the conventional cutting method and, therefore, the height of the core can be reduced to realize a thinner size of the coil device without reducing productivity.

Further, the structure in which the terminal has a coil retaining space (a through-hole or otherwise recess with a bottom) for securing therein a body portion of the core will permit easy positioning of the coil and improved assembly efficiency. Further, since a space for assembly is permitted in a height direction, dispersion of height in core production can be absorbed in the assembly procedure, so that dimensional allowance can be increased.

In the structure of the preferred embodiment of the invention in which the base seat has a projected rim at its circumferential end so that the coil is overlapped by the rim and the base seat is made of a mixture of a synthetic resin material and a magnetic material, it is possible to form a closed magnetic circuit by the combination of the projected rim of the base seat and the flange of the core, so that magnetic leakage of the coil is reduced, with the favorable result that the number of windings for a predetermined inductance can be decreased. This allows miniaturization of the coil device and the thickness of the wire for the coil can be made larger due to the reduced number of the winding. Thus, a DC resistance can be reduced to improve the electromagnetic properties.

In the other preferred embodiment, the opposed end of the one-sided is flange core is substituted with a jig, and the fusion bonded wire is wound directly around the body portion of the core. When the winding is applied to the one-sided flange core, the toroidal coil can be inserted on the body portion of the core. In this embodiment, the fusion bonded wire is applied directly to the body portion of the core. At the time of winding, the jig (a butt joint jig) for a winding machine is used for the other flange (that is, a "deleted" flange of the one-sided flange of the core) for a winding frame so that winding is formed between the other flange and the actual, one-sided flange. In the case of the direct winding as described, no clearance is required relative to the body portion of the core as required in the case of the prefabricated toroidal coil and, therefore, the clearance space can effectively be used such that the winding number can be increased and a dimension of the wire can be increased so that improvement in electromagnetic properties can be obtained. Further, an assembly efficiency can be improved relative to the case in which the toroidal coil is used.

In another embodiment of the present invention in which a coil device comprises a coil composed of a core and a winding on the core, and a terminal having a base seat for holding the coil and terminal elements. The base seat has a terminal fitting portion and a terminal element embedded in the terminal fitting portion, and the terminal element has wrapping (or bundling) portions at its ends and a mounting portion at its middle portion, and only a widthwise portion of the mounting portion is exposed. In this structure, the portion to be fixed by the molded resin is extended to thereby increase the fixing strength of the terminal elements. Further, this structure permits visual inspection of the welding condition of the terminal elements from an upper position.

In the second aspect of the invention described above, the mounting portion is exposed at the portion, which is positioned at the same plane of the bottom surface of the terminal. This will facilitate further miniaturization and improvement in the strength of the terminal elements because of the increased molded portion.

What is claimed is:

1. A coil device comprising:

a coil composed of a core and a winding on the core, said core including a body portion and a flange provided on only one side of the body portion; and a terminal having terminal elements and a base seat for holding the coil, the base seat defining a coil retaining space for securing therein the body portion of the core, wherein the coil retaining space is defined by a through hole formed in the base seat of the terminal, and wherein a diameter of the through hole is greater than or equal to a maximum diameter of the body portion.

2. A coil device comprising:

a coil composed of a core and a winding on the core, said core including a body portion and a flange provided on only one side of the body portion; and a terminal having terminal elements and a base seat for holding the coil, the base seat defining a coil retaining space for securing therein the body portion of the core, wherein the coil retaining space is defined by a through hole formed in the base seat of the terminal, and wherein each terminal element includes opposing wrapping or bundling portions and a mounting portion defined by a central portion of the terminal element, wherein only part of the mounting portion of each of the terminal elements is embedded in the material forming the terminal elements.

3. A coil device as claimed in claim 2, wherein each mounting portion is disposed on the same plane as a bottom surface of the base seat.

4. A coil device as claimed in claim 3, wherein each terminal element includes an angled portion on each side of the mounting portion, and the angled portions are completely embedded in the material forming the base seat.

* * * * *